US006310836B1

(12) United States Patent
Fujii et al.

(10) Patent No.: US 6,310,836 B1
(45) Date of Patent: Oct. 30, 2001

(54) TIMEPIECE

(75) Inventors: Teruhiko Fujii; Masami Fukuda; Junsuke Kashikie; Toshio Murata, all of Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/497,173

(22) Filed: Feb. 3, 2000

Related U.S. Application Data

(63) Continuation of application No. PCT/JP99/03705, filed on Jul. 8, 1999.

(30) Foreign Application Priority Data

Jul. 10, 1998 (JP) ..... 10-195170
Aug. 31, 1998 (JP) ..... 10-244920

(51) Int. Cl.[7] ..... G04B 3/00
(52) U.S. Cl. ..... 368/205; 368/88
(58) Field of Search ..... 368/204, 205, 368/228, 232, 281, 280, 282, 294–296

(56) References Cited

U.S. PATENT DOCUMENTS 6,021,099 * 2/2000 Aoki et al. ..... 36/205

FOREIGN PATENT DOCUMENTS 8-313651 11/1996 (JP) .
10-78486 3/1998 (JP) .
WO95/27234 10/1995 (WO) .

* cited by examiner

*Primary Examiner*—Bernard Roskoski
(74) *Attorney, Agent, or Firm*—Kanesaka & Takeuchi

(57) ABSTRACT

The present invention provides a timepiece having a light-receptive/emitting device such as a solar cell and an EL device in which a parting portion can be set freely and the timepiece can be adapted to various design requests. The timepiece has a dial for displaying a time, a timepiece movement incorporating driving units, a light-receptive/emitting device provided between the timepiece movement and the dial, and an armoring member for housing the timepiece movement, in which a portion or a whole of the dial is formed to have a light-transmitting property so as to supply outside light to the light-receptive/emitting device or to allow the light-receptive/emitting device to emit light to an outside, the light-receptive/emitting device is fixed to one side of the timepiece movement, and the dial is mounted to the armoring member by engaging a first portion formed at the dial with a second portion formed at the armoring member.

21 Claims, 13 Drawing Sheets

TIMEPIECE

CROSS REFERENCE TO RELATED APPLICATION

This is a continuation application of PCT International Application of PCT/JP99/03705 filed on Jul. 8, 1999.

TECHNICAL FIELD

The present invention relates to a timepiece including light-receptive/emitting means such as a solar cell and an EL (electroluminescence) device and a fixing structure of a dial to a timepiece movement.

BACKGROUND ART

In recent years, a solar cell is receiveing an attention as clean energy supplyer, which reflects environmental issues. Therefore, timepieces with their hands driven by energy which is generated by the solar cells and charged into storage units such as secondary batteries, capacitors, and the like are commercially available. Many timepieces having illuminating functions for illuminating the dial by using the EL device which is provided behind the dial are also commercially available.

As a fixing structure for fixing to the timepiece movement the solar cell which supplies power to driving units built into the timepiece movement, a fixing structure is disclosed in WO95/27234, for example.

FIG. 14 is a plan view of a timepiece movement of a conventional timepiece having a solar cell and FIG. 15 is a sectional view taken along line 15—15 in FIG. 14.

As shown in FIGS. 14 and 15, a metal plate 3 is mounted to an upper surface of a timepiece movement 2 which incorporates driving units and a train wheel bridge 4 made of metal is mounted to a lower surface of the timepiece movement 2. A light-transmitting dial 14 formed of transparent or translucent material is disposed above the metal plate 3.

As the driving units built into the timepiece movement 2, there is a stepping motor for moving the hands, for example. The stepping motor is driven by a transmitted signal from a circuit board 6 disposed outside the timepiece movement 2 and moves a second hand 7*a,* a minute hand 7*b,* and an hour hand 7*c*.

The circuit board 6 is supported by a circuit board support 8 made of plastic and provided at a periphery of the timepiece movement 2. Bolts 9 are inserted from a lower surface side of the timepiece movement 2 through the train wheel bridge 4, the circuit board 6, and the circuit board support 8, and the tips of the bolts 9 are screwed into threaded holes in the metal plate 3, thereby fixing the metal plate 3, the train wheel bridge 4, the circuit board 6, and the circuit board support 8 to the timepiece movement 2.

A solar cell 10 for supplying power to the driving units is formed of a metal thin plate and is disposed between the upper surface of the timepiece movement 2 and the circuit board support 8, and the light-transmitting dial 14. A solar cell support frame 11 made of a resin is mounted to a peripheral edge 8*a* of the circuit board support 8. The solar cell support frame 11 has a first portion 11*a* projecting from the peripheral edge of the circuit board support 8 toward the timepiece movement 2 and the first portion 11*a* engages with a peripheral edge of the solar cell 10 without interfering with the dial 14, thereby fixing the solar cell 10 to the circuit board support 8.

FIG. 16 is a partial sectional view of FIG. 14 for explaining conducting means for supplying power from the solar cell 10 to the circuit board 6. As shown in FIG. 16, conductive tape 12 is laminated on a surface of the solar cell 10 and is bonded by thermocompression to a terminal 10*a* provided to the surface of the solar cell 10 through an anisotropic conductive film. Between the solar cell 10 and the circuit board 6, a leaf spring 13 made of metal is provided to pass through the circuit board support 8 and a end of the leaf spring 13 is in contact with the conductive tape 12. The other end of the leaf spring 13 is bent along the surface of the circuit board 6 to be in contact with a terminal (not shown) of the circuit board 6.

A sectional view of a timepiece according to another prior art of the invention is shown in FIG. 17 for a reference purpose. Differences of this timepiece from one shown in FIGS. 14 to 16 is that power from the solar cell 10 which generates power by receiveing light is supplied to the circuit board 6 via a coil spring 13'. Because the other portions of the timepiece are similar to those in FIGS. 14 to 16, similar reference numerals and characters are provided to the similar portions to omit detailed descriptions of such portions.

FIG. 18 is a partial sectional view showing a state in which the timepiece movement shown in FIGS. 14 to 16 is housed in a case and FIG. 19 is a view taken along line 19—19 in FIG. 18.

As shown in FIGS. 18 and 19, a dial 14 is disposed on the solar cell 10 so as not to interfere with a solar cell support frame 11 and such that a peripheral edge of the dial 14 is positioned on a timepiece movement 2 side. A plurality of (two in the illustrated example) notch portions 14*a* in U-shape is defined on the peripheral edge of the dial 14 and dial fixing pins 8*b* defined to project from an upper surface of a circuit board support 8 are press-fitted into and engaged with the notch portions 14*a*. Thereby, the dial 14 is fixed to the timepiece movement 2 so as not to rotate.

In FIG. 18, a reference numeral 15 indicates the case as an outer member for housing the timepiece movement 2 and the like. An opening in which glass 16 is mounted is formed on an upper surface of the case 15. At a peripheral edge of the opening of the case 15, a parting portion 15*a* projecting inward is formed and a size of the parting portion 15*a* defines a range in which the dial 14 can be seen. The parting portion 15*a* is provided to cover a peripheral edge of the dial 14 from above at the offset place from the dial fixing pins 8*b* toward a center of the timepiece.

FIGS. 20 and 21 are external views of a timepiece with a conventional solar cell.

As shown in FIGS. 20 and 21, the parting portion 15*a* is provided to cover the peripheral edge of the dial 14 at the center side of the timepiece offset from the dial fixing pin portions 8*b* and has a circular shape (FIG. 20) similarly to the dial 14 or a shape of an ellipse (an odd shape) (FIG. 21) slightly smaller than the dial 14.

The above-described conventional timepieces have the following drawbacks. According to the fixing structure of the dial of the conventional timepiece, because an allowable range of the parting portion 15*a* of the timepiece movement is limited by the dial fixing pins 8*b,* the parting portion 15*a* can not be broadened outward from the dial fixing pins 8*b* and it is difficult to apply a similer design for the timepiece movement to various designs for the timepieces. In other words, if the parting portion 15*a* of the timepiece is broadened, the solar cell support frame 11 appears at an outer peripheral portion of the dial 14 through the case glass 16 and the tolerance of the parting portion 15*a* is limited by an inner diameter of the solar cell support frame 11. Therefore, in order to adapt to the various designs, an individual timepiece movement has been conventionally produced on a request for each design. As a result, the cost of producing the timepiece becomes high and production control of the timepiece movements is troublesome because many timepiece movements with various designs are necessary.

It is an object of the present invention to solve the above problems and to provide a timepiece having light-receptive/emitting means such as light-electric power generating means and an EL device, in which a tolerance of a parting portion can be set freely and a timepiece movement fixing structure can meet the various design requests.

DISCLOSURE OF THE INVENTION

To achieve the above object, according to the present invention, there is provided a timepiece having a dial for displaying a time, a timepiece movement incorporating driving units, light-receptive/emitting means provided between the timepiece movement and the dial, and an outer member for housing the timepiece movement, wherein a portion or a whole of the dial is formed to have a light-transmitting property so as to supply outside light to the light-receptive/emitting means or to allow the light-receptive/emitting means to emit light to an outside, the light-receptive/emitting means is fixed to one side of the timepiece movement, and the dial is positioned and mounted to the outer member by engaging a first portion formed at the dial with a second portion formed at the outer member.

Moreover, the outer case has a case for housing the timepiece movement and an inner frame member provided between an inner periphery of the case and the timepiece movement.

Furthermore, the inner frame member has a first member for retaining the timepiece movement and a second member for retaining the timepiece movement which are disposed between the inner periphery of the case and the timepiece movement, the first member and the second member support the timepiece movement between them from opposite sides to position and fix the timepiece movement in the case.

The light-receptive/emitting means is laminated to the timepiece movement with laminating means.

An overhanging portion which is a portion overhanging from the light-receptive/emitting means is formed at the timepiece movement and the first member for retaining the timepiece movement is provided to the overhanging portion.

The surface of the timepiece movement exposed through the gap between the light-receptive/emitting means and the first member for retaining the timepiece movement is colored with the color similar to the color of the surface of the light-receptive/emitting means.

BRIEF DESCRIPTION OF THE DRAWINGS

FIGS. 7 and 8 plan views showing other embodiments of the timepiece with different sizes and shapes of the case in which FIG. 7 shows an ellipse-shaped model and FIG. 8 shows a square model.

BEST MODE FOR CARRYING OUT THE INVENTION

Figure 1:
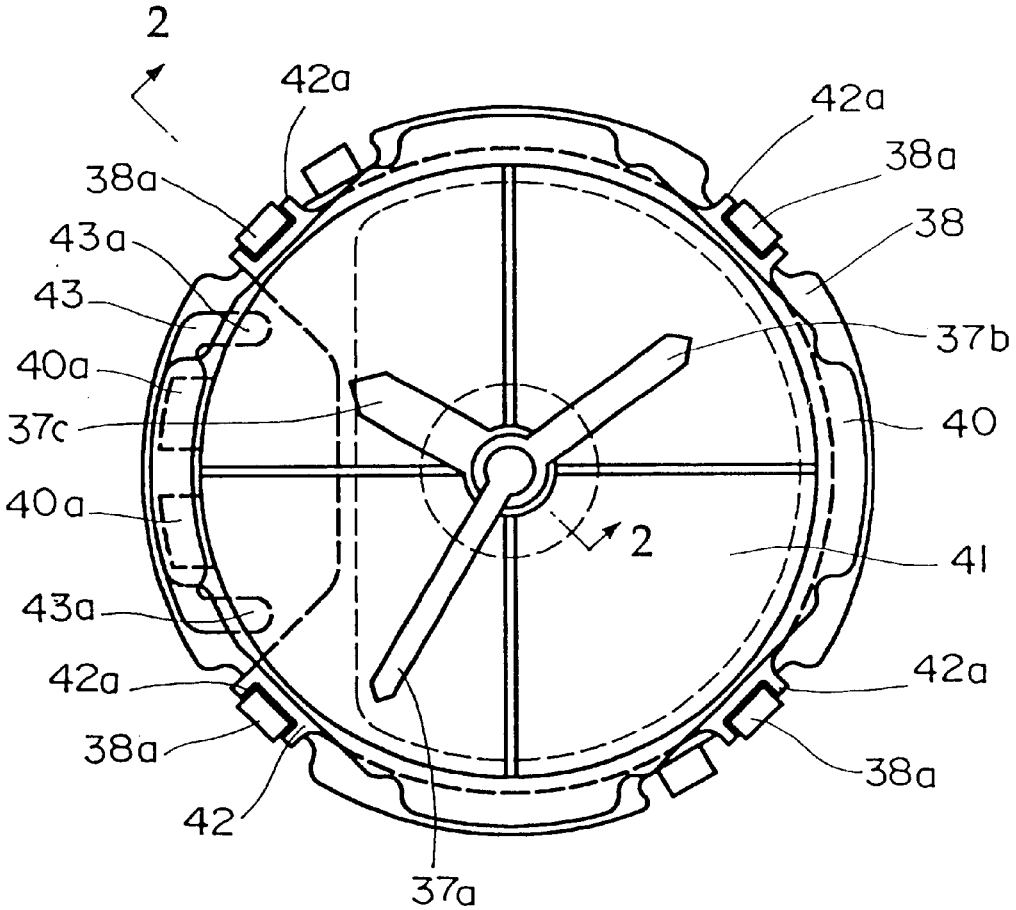
FIG. 1 is a plan view of a timepiece according to an embodiment of the present invention.

The embodiments of the present invention will be described below in detail by referring to the drawings.

Figure 2:
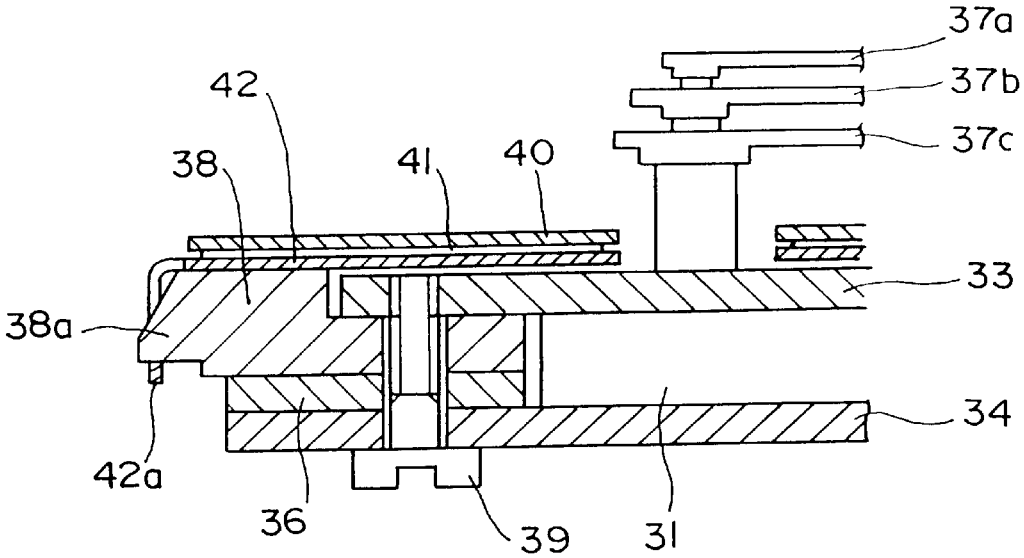
FIG. 2 is a sectional view taken along line 2—2 in FIG. 1.

FIG. 1 is a plan view of a rechargeable solar type timepiece according to a first embodiment of the invention and FIG. 2 is a sectional view taken along line 2—2 in FIG. 1.

As shown in FIGS. 1 and 2, a timepiece movement 31 incorporates driving units driven by electromotive energy from a solar cell 40 as light-receptive/emitting means. The driving units include a stepping motor, for example, for moving a second hand 37*a*, a minute hand 37*b*, and an hour hand 37*c* by reference signals from a circuit board 36.

The timepiece movement 31 is mounted at an upper surface thereof with a metal plate 33 and at a lower surface of the timepiece movement 31 with a train wheel bridge 34 made of metal. The circuit board 36 is supported by a circuit board support 38 made of plastic and provided to a periphery of the timepiece movement 31. The circuit board 36 and the circuit board support 38 are fixed to the timepiece movement 31 by fixing screws 39 screwed down into the metal plate 33 through the train wheel bridge 34, the circuit board 36, and the circuit board support 38.

A thin metal plate 42 is fixed to the timepiece movement 31. The metal plate 42 is mounted to the circuit board support 38 by bending a plurality of hooks 42*a* formed at a peripheral edge of the metal plate 42 downward and engaging the hooks 42*a* with hook engaged portions 38*a* of the circuit board support 38. The solar cell 40 having a metal plate as base material is laminated on the metal plate 42 through insulating double-faced tape 41 with adhesive faces.

Figure 3:
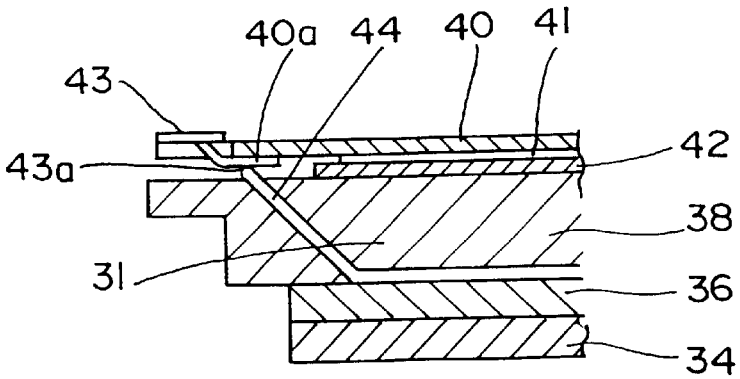
FIG. 3 is a sectional view of a connection portion for conductive-connecting a solar cell and a circuit board.

FIG. 3 is a sectional view of a connection portion for conductive-connecting the solar cell 40 and the circuit board 36.

As shown in FIG. 3, conductive tape 43 electrically connects a terminal 40*a* (see FIG. 1) provided to an upper surface of the solar cell 40 by themocompression through an anisotropic conductive film. A leaf spring 44 extends through the circuit board support 38 from the solar cell 40 to the circuit board 36. An end of the leaf spring 44 is in contact with a contact portion 43*a* of the conductive tape 43 bent toward a lower surface side of the solar cell 40. The other end portion of the leaf spring 44 is bent along the circuit board 36 to be in contact with a terminal (not shown) of the circuit board 36. By this structure, electromotive force generated by the solar cell 40 is sent to the circuit board 36 through the terminal 40*a,* the conductive tape 43, the contact portion 43*a,* and the leaf spring 44.

Figure 4:
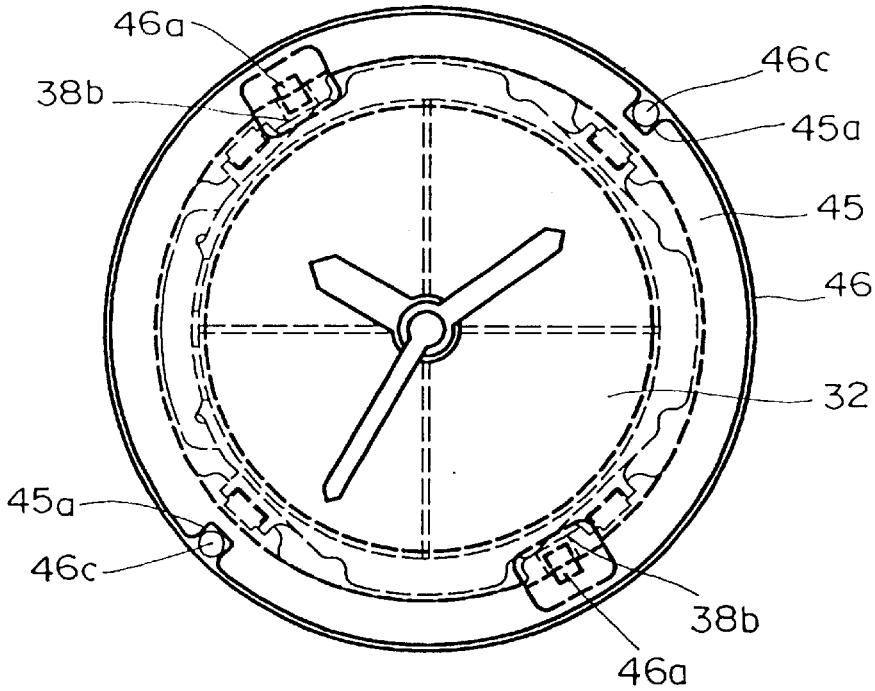
FIG. 4 is a plan view showing a state in which a dial fixing frame is mounted to a periphery of a timepiece movement shown in FIGS. 1 to 3.
Figure 5:
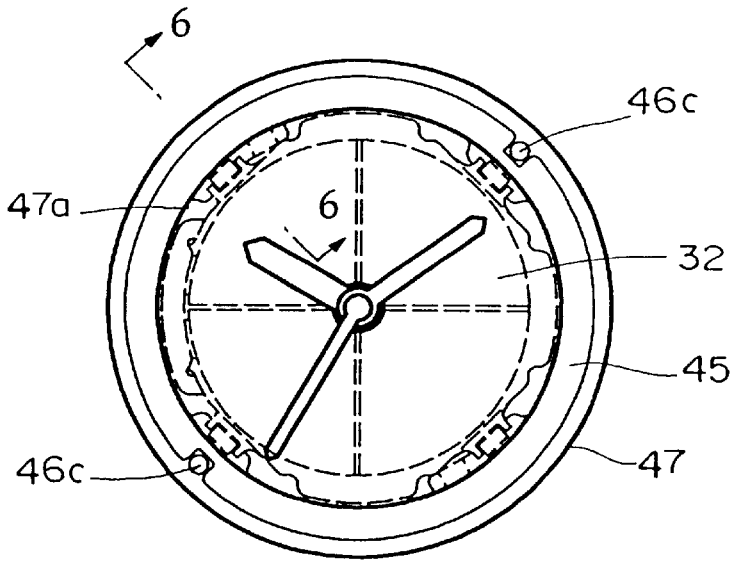
FIG. 5 is a plan view showing a state in which the timepiece movement shown in FIG. 4 is further housed in a case.
Figure 6:
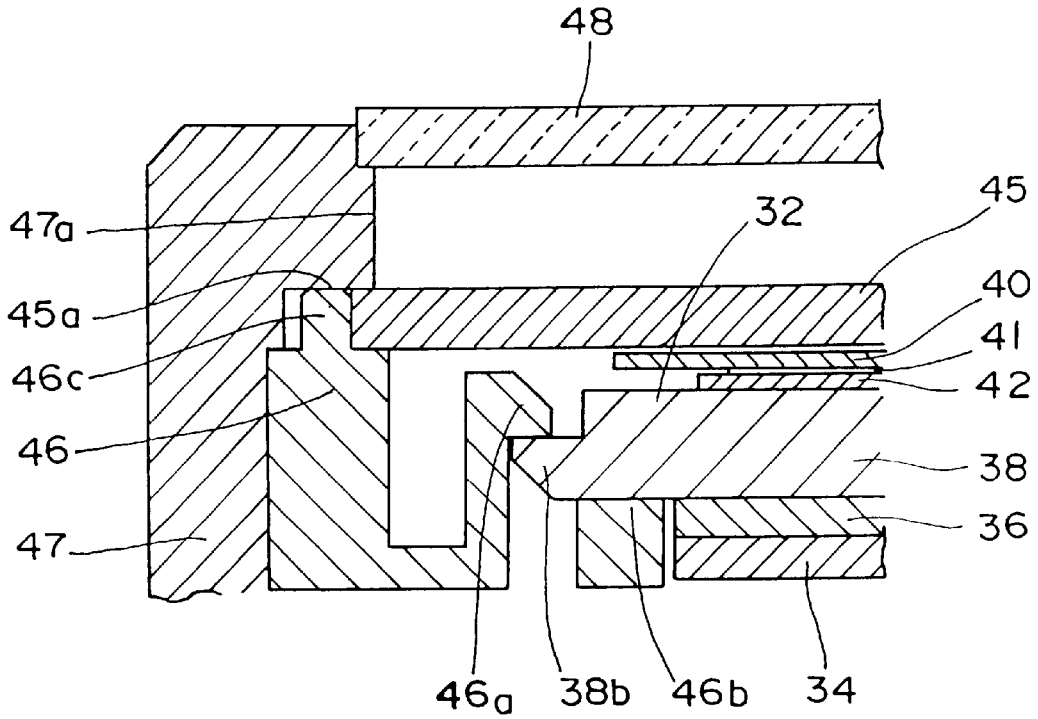
FIG. 6 is a sectional view taken along line 6—6 in FIG. 5.

FIG. 4 is a plan view showing a state in which a dial fixing frame 46 is mounted to a periphery of the timepiece movement 31 shown in FIGS. 1 to 3, FIG. 5 is a plan view showing a state in which the timepiece movement 31 shown in FIG. 4 is further housed in a case 47, and FIG. 6 is a sectional view taken along line 6 in FIG. 5.

As shown in FIGS. 4 to 6, a dial fixing frame 46 as an inner frame member for positioning and fixing the timepiece movement 31 in the case 47 of the timepiece is mounted to an outside of the timepiece movement 31. The dial fixing frame 46 is formed to fit a shape of an inner face side of the case 47 and has stepped portions 46*b* extending to a lower surface side of the circuit board support 38 and hooks 46*a* extending to an outer peripheral edge of the circuit board support 38. It is preferable to provide a plurality of hooks 46*a* and stepped portions 46*b* at predetermined intervals so as to reliably position and fix the timepiece movement 31 in the case 47 through the circuit board support 38. If the timepiece movement 31 is housed in the circular case 47 as shown in FIG. 5, it is preferable to provide three or four hooks 46*a* and stepped portions 46*b* at uniform intervals.

The stepped portions 46*b* abut on a lower surface of the circuit board support 38 and the hooks 46*a* engage with portions 38*b* formed to project from an outer periphery of the circuit board support 38.

A plurality of dial fixing pin portions 46*c* is formed to project from the dial fixing frame 46 at predetermined intervals. On the other hand, a plurality of notches 45*a* to be engaged with pin portions 46*c* for fixing the dial 45 is formed in a peripheral edge portion of the dial 45. By fitting and engaging the pin portions 46*c* into the notch portions 45*a,* the dial 45 is positioned with respect to the timepiece movement 31.

The dial 45 is formed of a light-transmitting member for admission of outside light. The dial 45 is formed to have an area which is larger than at least an effective power-generating area (effective light-receptive/emitting area) of the solar cell 40 for generating electromotive energy required to active the timepiece. The dial 45 may be transparent or translucent if it has a property of transmitting light, but it is preferable that a portion of the dial 45 corresponding to the effective power-generating portion of the solar cell 40 has a higher light-transmitting rate than the other portion. If at least the portion corresponding to the effective power-generating portion of the solar cell 40 has the light-transmitting property, the other portion may not transmit light and may be formed as an opaque portion or an opaque member may be laminated to the portion.

Glass 48 is fitted into and fixed to an opening of the case 47. A peripheral edge of the opening of the case 47 is formed to overhang inward, thereby forming a parting portion 47*a* for determining an area of the dial 45 which can be seen.

The timepiece movement 31 with the dial fixing frame 46 is housed in the case 47 in a state in which a back is detached. When the back is attached to the case 47, the dial fixing frame 46 is fixed in the case 47, thereby positioning and fixing the timepiece movement 31 to a predetermined position.

If the timepiece movement 31 is fixed in the case according to the present invention, it is possible to apply a common timepiece movement 31 to case bodies 47 with different shapes and sizes. In this case, it is prefered that a plurality of dials 45 and dial fixing frames 46 which are suitable to sizes and shapes of the cases 47 are prepared to replace the original dial fixing frame 46 and the dial 45 and to be mounted to the timepiece movement 31.

Figure 7:
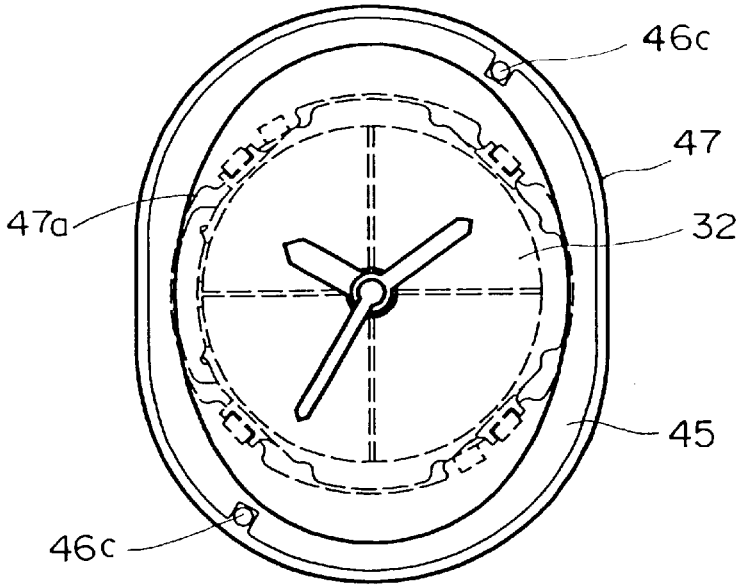
Figure 8:
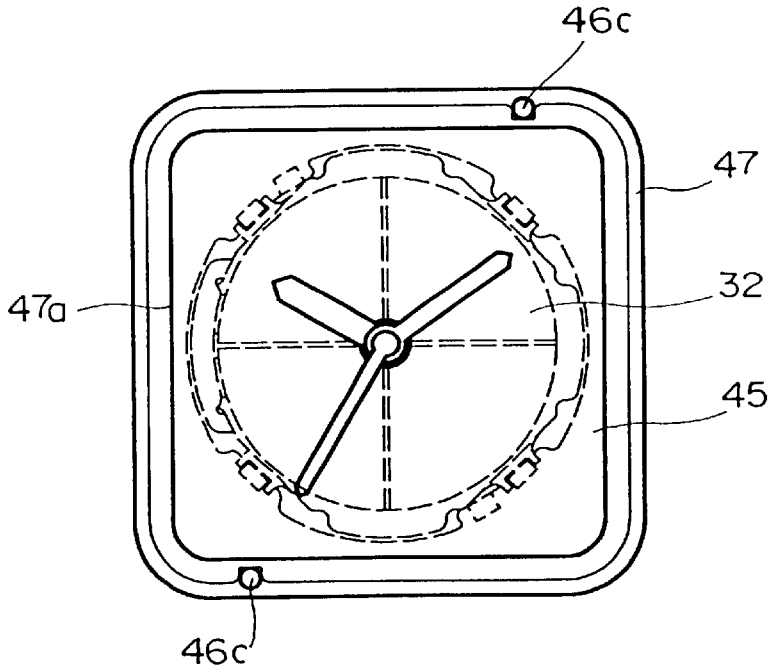

FIGS. 7 and 8 are plan views showing other embodiments of the timepiece with different sizes and shapes of the case in which FIG. 7 shows an ellipse-shaped model and FIG. 8 shows a square model.

An fixing frame for the dial in ellipse-shape and an ellipse-shaped dial are applied to the case 47 in FIG. 7. The parting portion 47*a* is also formed to fit an outside shape of the case 47. Because the dial fixing pin portions 46*c* are hidden by the parting portion 47*a,* the dial fixing pin portions 46*c* can not be seen from outside and do not spoil an outward appearance of the timepiece.

A square dial fixing frame and a square dial are applied to the case 47 in FIG. 8. In this case, similarly, the parting portion 47*a* is formed to fit a shape of the case 47, can not be seen from outside, and does not spoil an outward appearance of the timepiece.

In any of the timepieces shown in FIGS. 6 to 8, because the parting portion 47*a* is positioned outside the timepiece movement 31, it is possible to set an area of the dial 45 at a larger value than an area (effective area for generating power) of the solar cell 40, thereby obtaining sufficient power.

Figure 9:
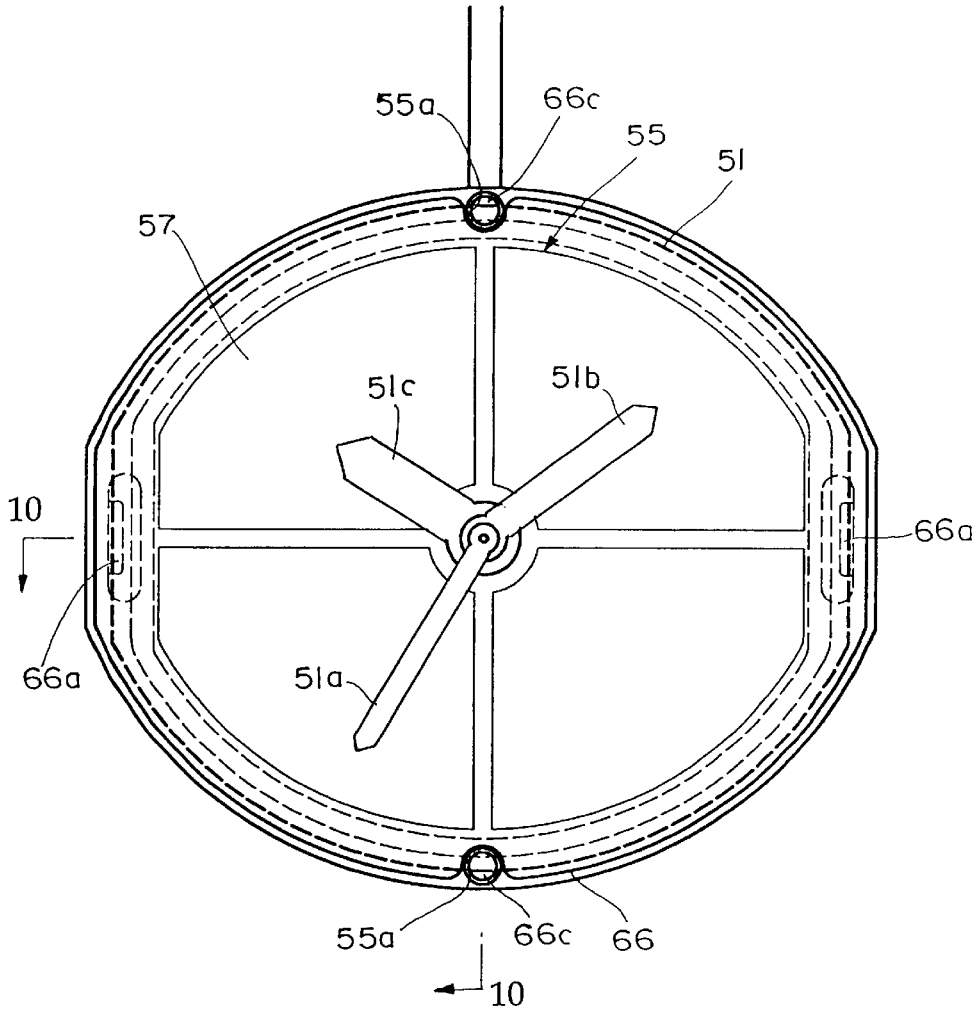
FIG. 9 is a plan view of a timepiece according to another embodiment of the invention.
Figure 10:
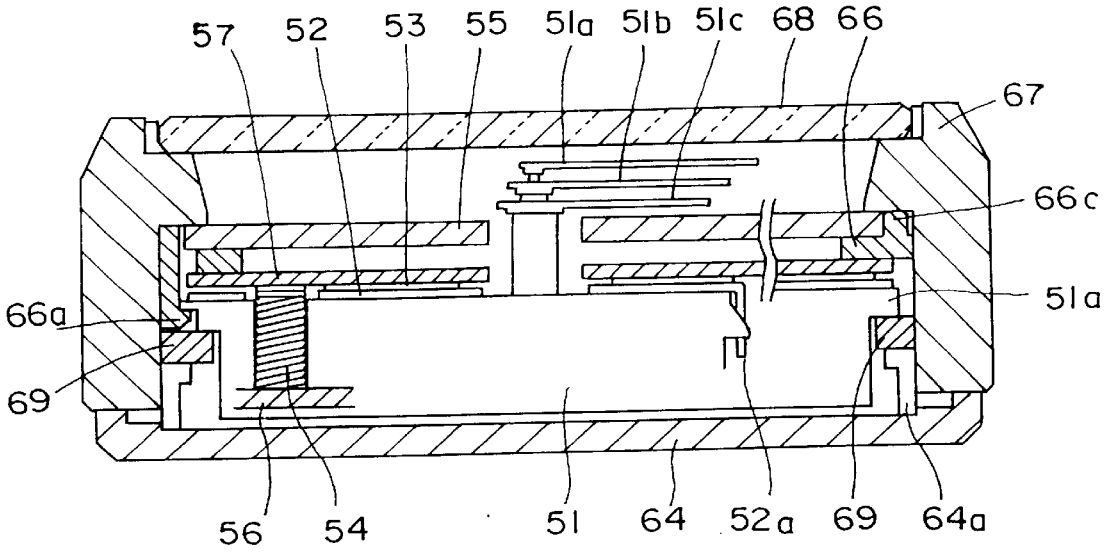
FIG. 10 is a sectional view taken along line 10—10 in FIG. 9.

FIG. 9 is a plan view of a timepiece according to a second embodiment of the invention and FIG. 10 is a sectional view taken along line 10—10 in FIG. 9.

In FIGS. 9 and 10, the timepiece movement 51 is formed into a barrel shape. The timepiece movement 51 has a second hand 51*a,* a minute hand 51*b,* and an hour hand 51*c*. The solar cell 57 is formed like a film on a film substrate in the present embodiment and an outward form of the solar cell 57 is a barrel shape substantially similar to that of the timepiece movement 51 as shown in FIG. 9. Because the solar cell 57 is formed like the film substrate, it is possible to cut the solar cell 57 into a free shape relatively easily.

The solar cell 57 is bonded and fixed to a solar cell mounting plate 52 by a double-faced tape 53 as above-mentioned. The solar cell mounting plate 52 is retained by engagement of a hook 52*a* with the timepiece movement 51. Power of the solar cell 57 is transmitted through a coil spring 54 to a circuit board 56 and activates driving units in the timepiece movement 51.

A dial 55 is formed of light-transmitting material applied with various colors such as white, blue, and the like and patterns to adapt to diversification of design such that the solar cell 57 disposed below the dial 55 can receive light to generate power. The material may be transparent or translucent if it has a light-transmitting property. It is possible to employ ceramic material, colored plastic, and the like, for example, as base material. The translucent portion may be formed by applying rough processing to a transparent portion, for example.

On the solar cell 57, a dial mounting plate 66 made of plastic material as a first member for retaining the timepiece movement is disposed. The dial mounting plate 66 has a convex portion 66*c* projecting upward and the convex portion 66*c* is fitted into and engaged with a concave portion 55*a* formed in a peripheral edge of the dial 55, thereby positioning the dial 55. An outer peripheral edge of the dial mounting plate 66 abuts on an inner peripheral face of the case 67, thereby the timepiece movement 51 is positioned within the case 67.

Hook portions 66*a* extending downward are formed at a plurality of positions (two positions facing each other in the embodiment) of the dial mounting plate 66. By engaging the hooks 66*a* with an outer peripheral edge of the timepiece movement 51, the dial mounting plate 66 is prevented from being detached from the timepiece movement 51 when the hands are assembled or the movement 51 is put into the case.

At an outer periphery of the timepiece movement 51, an auxiliary ring 69 as a second member for retaining the timepiece movement is provided. The auxiliary ring 69 is engaged with a flange portion 51*a* of the timepiece movement 51 and abuts on an inner face of the case 67 to retain the timepiece movement 51. The auxiliary ring 69 is supported by a core 64*a* formed to stand on the back lid 64 when the back lid 64 is mounted to the case 67.

According to the above structure, the timepiece movement 51 is supported between the dial mounting plate 66 as the first member for retaining the timepiece movement and the auxiliary ring 69 as the second member for retaining the timepiece movement and is positioned and fixed within the case 67. In order to adapt to the parting portions of various sizes, sizes and shapes of the dial 55, the dial mounting plate 66, and the auxiliary ring 69 may be changed, however it is not necessary to change the timepiece movement 51. Because the dial mounting plate 66 and the auxiliary ring 69 are relatively simple structures and are outer parts independent of the timepiece movement 51, it is relatively easy to prepare the dial mounting plates 66 and auxiliary rings 69 of different shapes. In other words, according to the embodiment, it is possible to relatively easily obtain a completed timepiece with a free design such as not only a barrel but also a circle and a square by changing the dial mounting plate 66, the auxiliary ring 69, and the dial 55.

Because the timepiece movement 51 is fixed firmly in a state in which the timepiece movement 51 is supported between the dial mounting plate 66 and the auxiliary ring 69, the structure can be made excellently shock-resistant. In other words, against a shock from a case glass 68 side, the timepiece face mounting plate 66 disposed on an upper surface side of the timepiece movement 51 reliably retains the timepiece movement 51 and the auxiliary ring 69 disposed at a periphery of the timepiece movement 51 reliably retains the timepiece movement 51 against a shock from the back lid 64 side. Therefore, the timepiece movement 51 does not remove out in any directions.

The timepiece movement 51 and the dial mounting plate 66 are necessary to be integrated with each other so as not to be separated from each other in assembly of the hands 51*a*, 61*b*, and 51*c* and putting of the timepiece movement 51 into the case 67. Therefore, a structure in which the hooks 66*a* of the dial mounting plate 66 are engaged with the timepiece movement 51 is employed in the embodiment, but other structures may be also employed.

Figure 11:
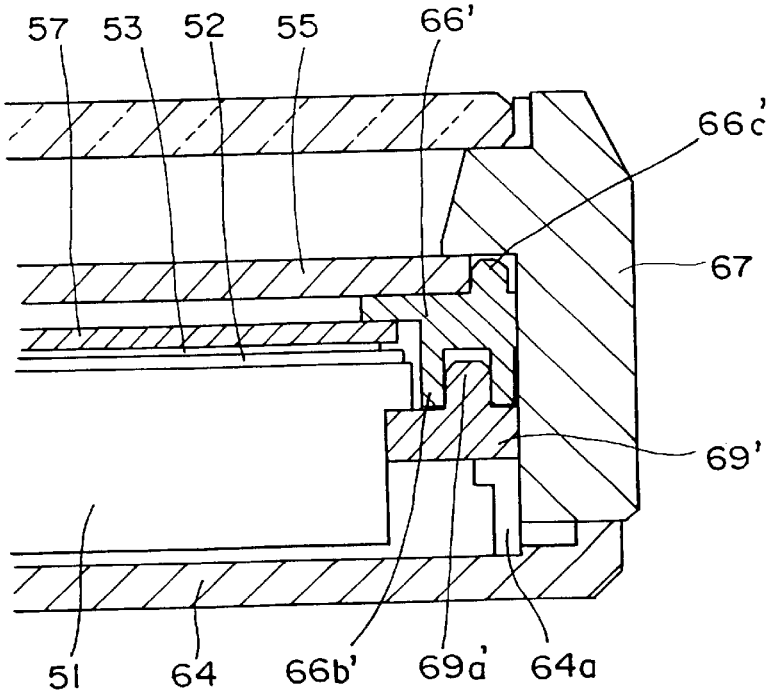
FIG. 11 is a sectional view of an essential portion showing another embodiment of a fixing structure.

FIG. 11 is a sectional view of an essential portion showing another embodiment of a fixing structure. In FIG. 11, similar reference numerals and characters are provided to portions similar to those in FIGS. 9 and 10.

A reference numeral 69' denotes an auxiliary ring formed of plastic material. Convex portions 69*a'* are formed at a plurality of positions of the auxiliary ring 69'. A reference numeral 66' denotes a dial mounting plate which is formed of the plastic material similarly to the auxiliary ring 69'. The dial mounting plate 66' has concave portions 66*b'* which correspond to the convex portions 69*a'* of the auxiliary ring 69' and have a slightly smaller width. The timepiece movement 51 is positioned and fixed by the auxiliary ring 69' and the dial mounting plate 67'. At this time, the convex portions 69*a'* of the auxiliary ring 69' are press-fitted into the concave portions 66*b'* of the dial mounting plate 66' to firmly secure the auxiliary ring 69' and the dial mounting plate 66' to each other, thereby preventing separation of them from each other when they are housed in the case. Although the convex portions 69*a'* are formed on the auxiliary ring 69' and the concave portions 66*b'* are formed on the dial mounting plate 66' in the embodiment, it is also possible to form the convex portions on the dial mounting plate 66' and to form the concave portions on the auxiliary ring 69'.

Figure 12:
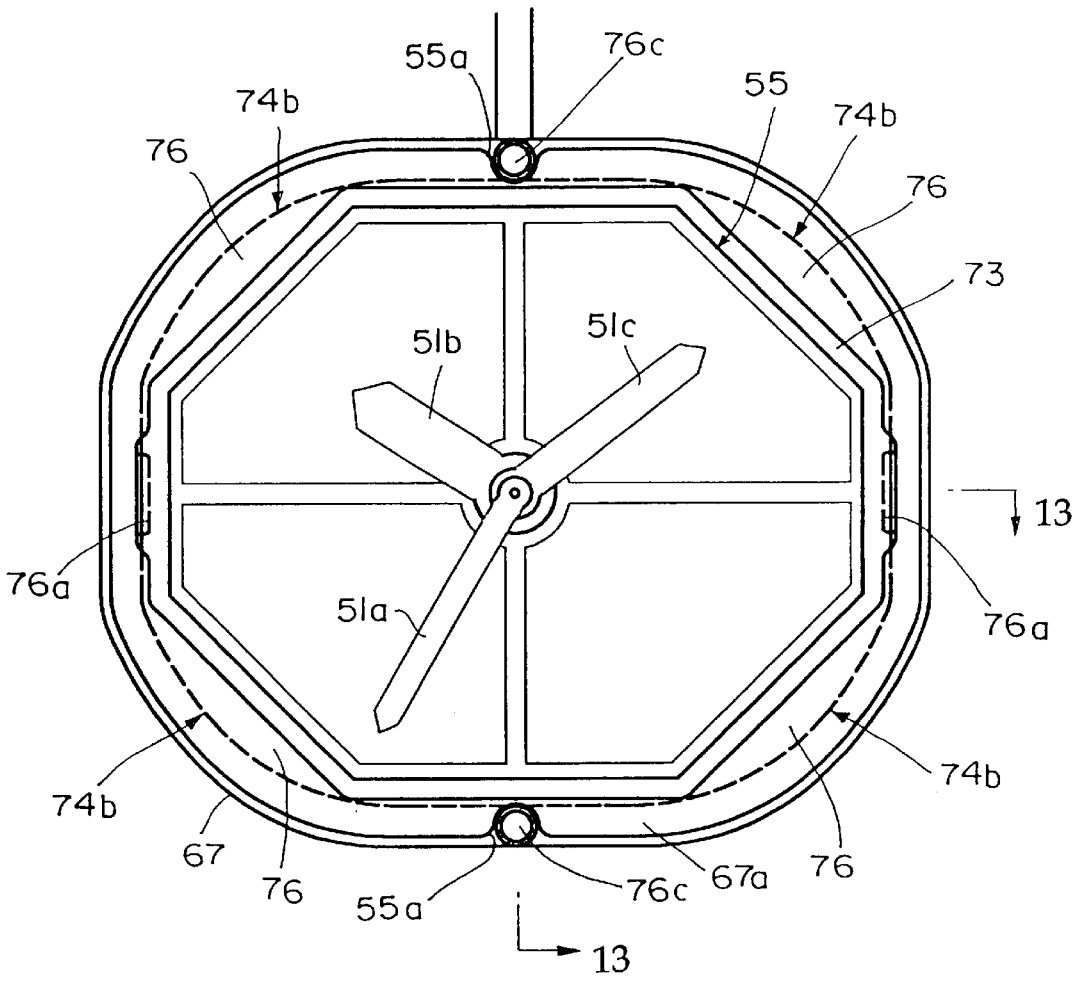
FIG. 12 is a plan view of a rechargeable solar type timepiece of a third embodiment of the invention.
Figure 13:
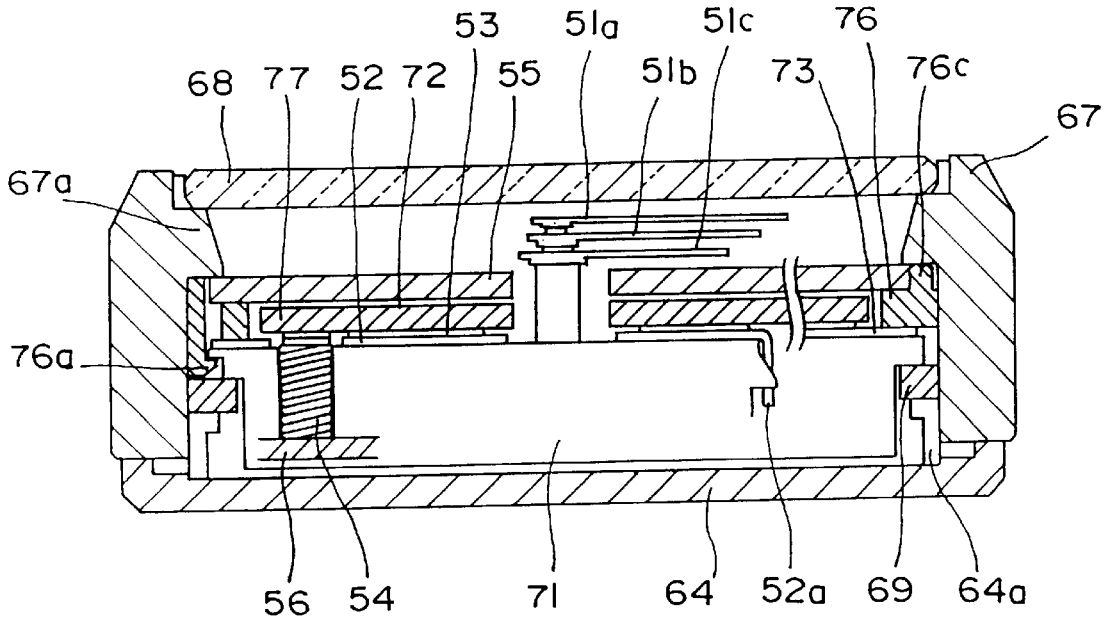
FIG. 13 is a sectional view taken along line 13—13 in FIG. 12.
Figure 14:
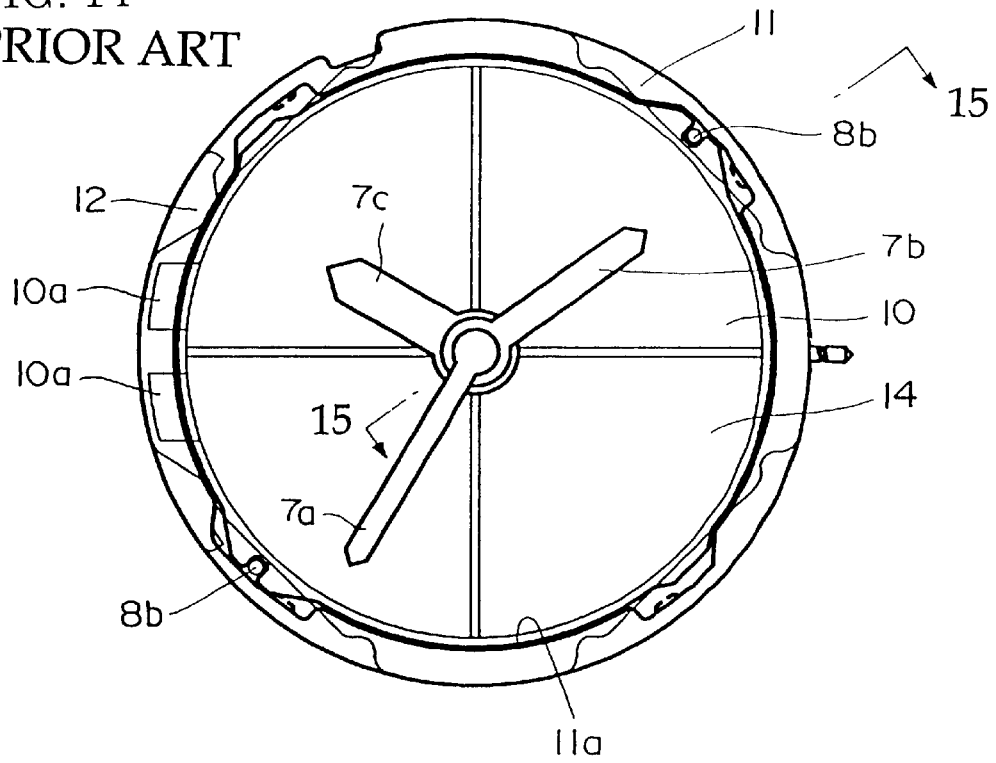
FIG. 14 PRIOR ART
FIG. 14 is a plan view of a timepiece movement of a conventional timepiece with a solar cell.
Figure 15:
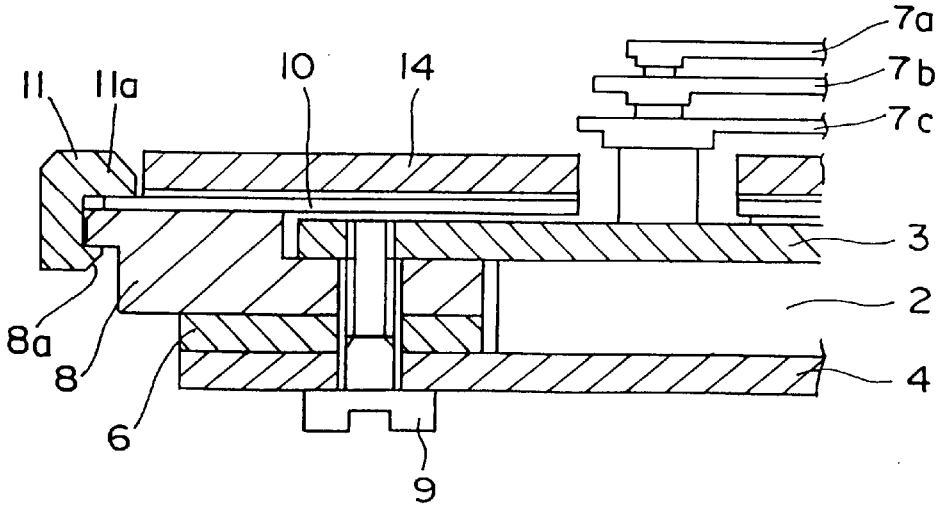
FIG. 15 PRIOR ART
FIG. 15 is a sectional view taken along line 15—15 in FIG. 14.
Figure 16:
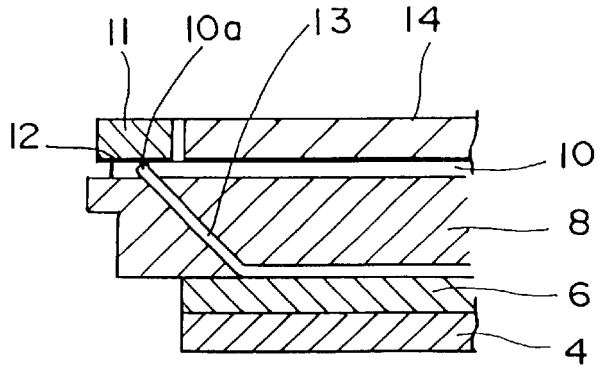
FIG. 16 PRIOR ART
FIG. 16 is a partial sectional view of FIG. 14 for describing conducting means for supplying power from the solar cell to a circuit board.
Figure 17:
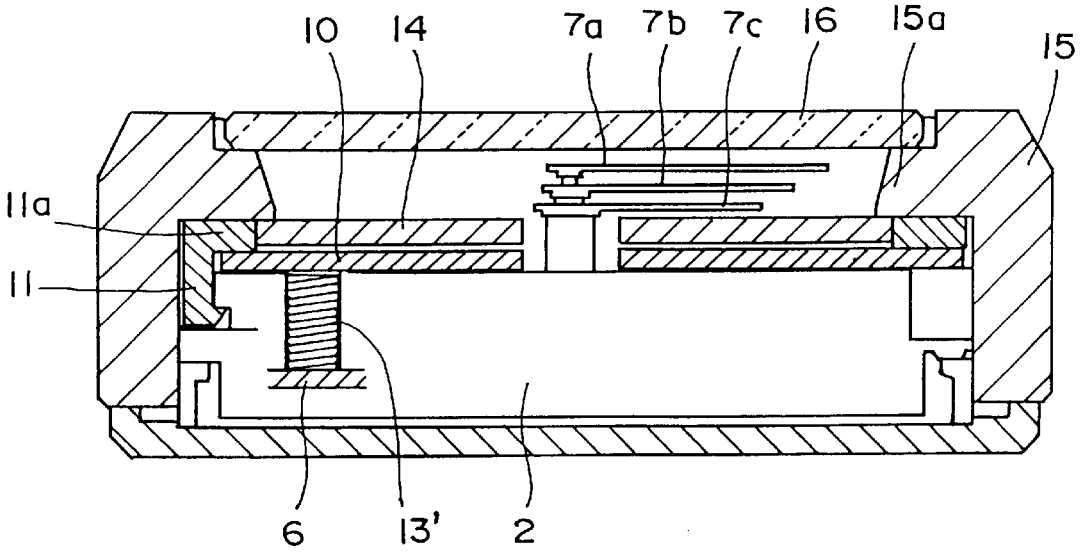
FIG. 17 PRIOR ART
FIG. 17 is a sectional view of a timepiece according to another piece of prior art of the invention.
Figure 18:
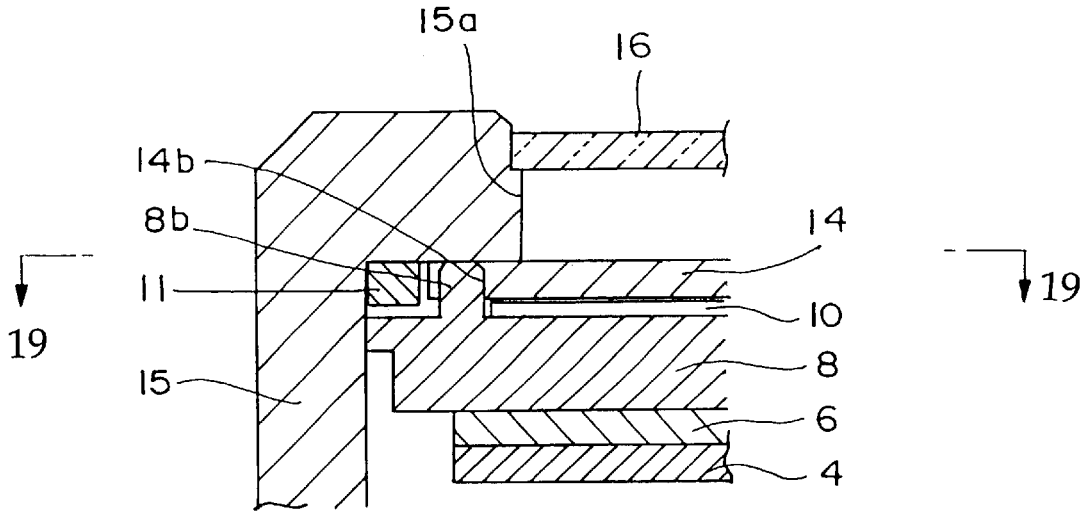
FIG. 18 PRIOR ART
FIG. 18 is a partial sectional view showing a state in which a timepiece movement shown in FIGS. 14 to 16 is housed in a case.
Figure 19:
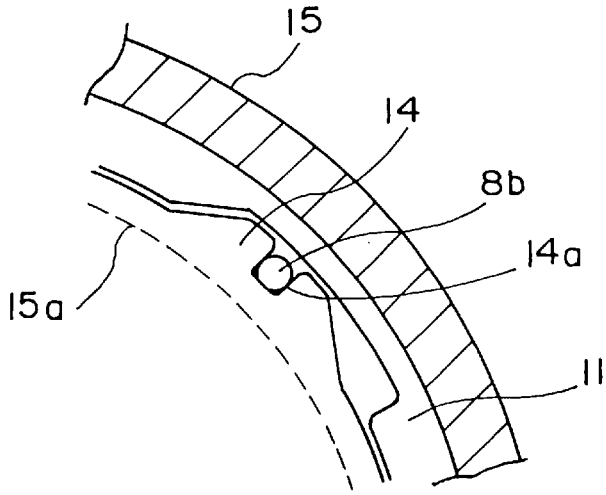
FIG. 19 PRIOR ART
FIG. 19 is a sectional view taken along line 19—19 in FIG 18.
Figure 20:
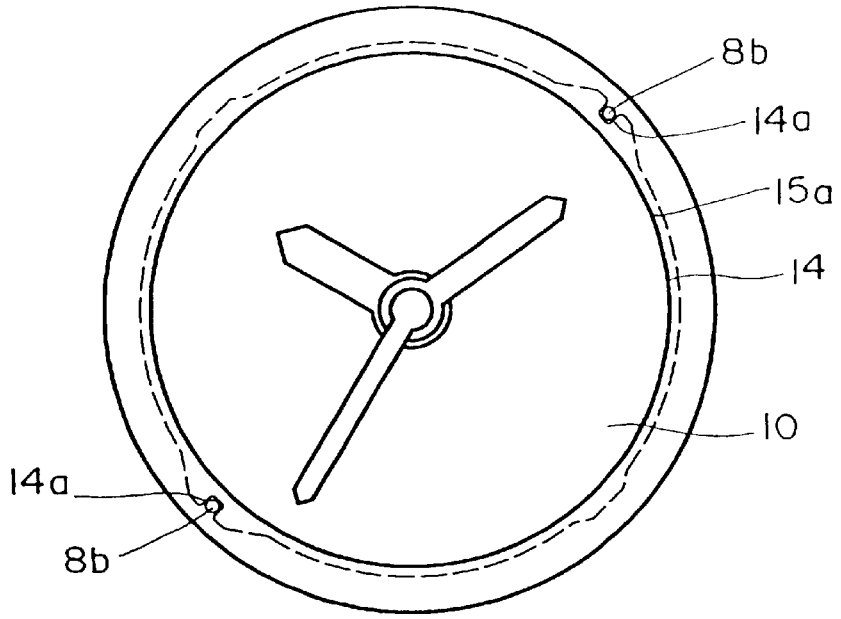
FIG. 20 PRIOR ART
FIGS. 20 and 21 are external views of a conventional timepiece with a solar cell in prior art.
Figure 21:
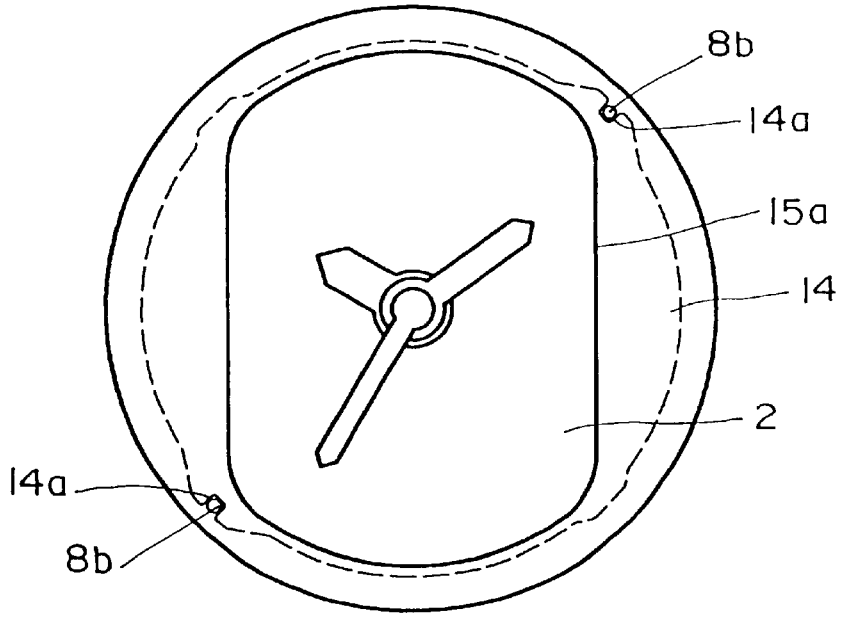
FIG. 21 PRIOR ART

FIG. 12 is a plan view of a rechargeable solar type timepiece of a third embodiment of the invention and FIG. 13 is a sectional view taken along line 13—13 in FIG. 12.

A structure of the embodiment will be described in detail according to FIGS. 12 and 13. Because a basic structure of the embodiment is similar to that in the above second embodiment, similar reference numerals and characters are provided to the similar portions and members to omit detailed descriptions of such portions and members.

A solar cell 77 with glass base material has an outside shape of an octagon as shown in FIG. 12.

It is desirable that the solar cell 77 has a curved outside shape if the solar cell 77 is disposed in a circular or barrel-shaped outside shape of the timepiece movement 71. However, because it is difficult to cut the solar cell 77 with glass base material into a curved shape, the solar cell 77 is in a shape of the octagon with a linear edge. The solar cell 77 is laminated and fixed to the solar cell mounting plate 52 made of metal by double-faced tape 53. Therefore, portions of the timepiece movement 71 are formed with overhanging portions 74*b* overhanging from the outside shape of the solar cell 77.

The dial mounting plate 76 made of the plastic material is disposed on the overhanging portions 74*b* on an upper surface side of the timepiece movement 71 so as not to interfere with the solar cell 77. The dial mounting plate 76 positions the dial 55 based on the overhanging portions 74*b*. The dial mounting plate 76 is in contact with an inner face of the case 67. Thereby the dial mounting plate 76 and the auxiliary ring 69 position and retain the timepiece movement 71 within the case 67. This fixing structure is similar to that in the above embodiment shown in FIG. 10.

By the above structure, also in the present embodiment, it is possible to apply the same timepiece movement 71 to the timepieces with various sizes of parting portions by only changing sizes and shapes of the dial 55, the dial mounting plate 76, and the auxiliary ring 69 similarly to the above embodiment.

On the other hand, in the present embodiment, because the timepiece movement 71 is supported by the dial mounting plate 76 at an outside of the solar cell 77, it is advantageously possible to reduce a gap 72 between the solar cell 77 and the dial 55 to reduce a total thickness of the completed timepiece in contrast to the above embodiments.

Especially in the present embodiment in which the solar cell 77 is made of the glass base material, a thickness of the glass base material increases to some extent for strength. Therefore, it is especially advantageous to reduce the gap 72 by a design change.

On the other hand, because the solar cell mounting plate 76 retains the timepiece movement 71 at the outside of the solar cell 77, the timepiece extends in a plane direction and a plane area of the timepiece is likely to increase. However, if the octagon-shaped solar cell 77 is disposed on the curved timepiece movement 71 like in the embodiment, portions (the overhanging portions 74*b* in the embodiment) of the timepiece movement 71 necessarily overhang from the solar cell 77. If the dial mounting plate 76 is provided to such portions, the plane area of the timepiece does not increase so much.

Because the solar cell 77 is formed of the glass base material, the solar cell 77 has low strength and may be cracked and broken. However, according to the embodiment, because the timepiece movement 71 is supported between the solar cell mounting plate 76 and the auxiliary ring 69 not through the solar cell 77, external force is not directly applied to the solar cell 77. Therefore, the solar cell 77 is not broken in assembly of the timepiece and has a structure resistant to a shock from outside.

In order to further increase the strength to resist the shock, it is preferable to set a size of the gap 72 between the solar cell 77 and the dial 55 at an appropriate value. Even if the timepiece movement 71 bends when a impact is applied from outside and pushes the solar cell 77 toward the dial 55, the appropriate size of gap 72 prevents the solar cell 77 from abutting on the dial 55 and thus, the solar cell 77 with the glass base material is not broken. The size of the gap is preferably obtained by various experiments and is preferably set at about a value between 30 $\mu$m to 200 $\mu$m.

The dial 55 is adapted to diversification of design while being formed of translucent base material for transmitting light to the solar cell 77. Therefore, if parts of quite different colors are disposed below the dial 55, such parts can be seen through the dial 55, which causes a problem of the outside appearance.

Therefore, in the third embodiment, a face (upper surface) of the solar cell mounting plate 52 made of metal on the dial 55 side is preferably applied with plating or painting of a black-like color which is a color similar to that of the solar cell 77. As a result, even if the solar cell mounting plate 76 is seen through a slit-shaped gap 73 between the solar cell 77 and the dial mounting plate 76, the solar cell mounting plate 76 is not so conspicuous from outside when it is seen through the translucent dial 55.

Even if the size of the gap 73 is reduced, a metal surface reflects light and a luster of the metal surface is conspicuous. Therefore, it is the most effective to hide the metallic luster by plating or painting like in the embodiment. It is also preferable to color the dial mounting plate 76 made of plastic material with a color similar to that of the solar cell 77. In other words, if the parts disposed below the dial 55 are colored with similar colors, the parts are not conspicuous when seen through the dial 55 to cause the problem of the outside appearance. As a result, it is possible to improve the light-transmitting rate of the dial 55, thereby improving charging performance while maintaining latitude in design of the dial 55.

Although the solar cell which receives light and generates power is employed for the timepiece as light-receptive/emitting means in the above respective embodiments, the present invention can be also applied to light-emitting means such as an illuminating unit, e.g., an EL device which emits light to the outside.

Although the dial fixing frame is provided as an inner frame member and the dial is fixed to the dial fixing frame in the above descriptions, it is also possible to directly mount the dial to the timepiece case as the outer member.

As is clear from the above descriptions, by using the structure of the rechargeable solar type timepiece of the invention, it is possible to set the parting portion freely by only changing the dial and the dial fixing frame and to adapt the structure to various designs at low cost.

According to the invention, a bonding member between the metal plate and the solar cell functions as an insulating layer by the above mentioned timepiece movement fixing structure of the above structure, therefor there is no conductivity between the metal plate and the solar cell even if the metal plate is conductive. And the timepiece function is not damaged, even if the solar cell contacts a member such as the case.

Moreover, according to the invention, it is possible to set the parting portion freely by only changing the dial, the dial mounting plate, and the auxiliary ring and to adapt the structure to various designs at low cost. If the timepiece movement is reliably retained from above and below by the first retaining member and the second retaining member, the timepiece is strong to resist to the shock from outside and the highly reliable timepiece can be obtained.

Furthermore, if the timepiece movement is retained at the portions which do not overlap the solar cell, force is not applied to the solar cell itself. As a result, it is possible to obtain a completed timepiece with more excellent shock resistance, which is effective especially when the solar cell with glass base material with poor strength is mounted.

If the surface of the part (e.g., timepiece movement) disposed at a position which is seen through the gap between the solar cell and the inner frame member is colored with the color similar to that of the solar cell as suggested in the invention, the part is not conspicuous even if the light-transmitting rate of the dial is increased. Therefore, it is possible to increase the latitude in design and to improve the power generating property.

INDUSTRIAL APPLICABILITY

The present invention can be extensively applied to a timepiece including a dial for indicating a time, light-receptive/emitting means such as a solar cell and an EL device provided on one side of the dial for operating by receiveing outside light or for emitting light to the outside, a timepiece movement incorporating driving units, and a case for housing the timepiece movement.

What is claimed is:

1. A timepiece comprising:

a timepiece movement having driving units, light means provided above the timepiece movement for receiving or emitting light and having a light portion for receiving or emitting light, fixing means for fixing the light means to one side of the timepiece movement to thereby form an assembly of the timepiece movement and the light means, a dial for displaying time disposed above the light means, said dial having at least partly a light-transmitting property to provide outside light to the light means or to allow the light means to emit light to an outside, a display area larger than the light portion, and a first positioning and engaging portion formed outside the light portion of the light means, and an outer member having a second positioning and engaging portion engaging the first positioning and engaging portion of the dial to fix the dial, said assembly of the timepiece movement and the light means being housed in the outer member fixed with the dial.

2. The timepiece according to claim 1, wherein said fixing means is laminating means.

3. The timepiece according to claim 1, wherein a whole of the dial is formed to have the light-transmitting property and a portion of the dial corresponding to the light portion of the light means has a higher light-transmitting rate than the other portion of the dial.

4. The timepiece according to claim 1, wherein a portion of the dial corresponding to the light portion of the light means is formed as a light-transmitting portion and a portion of the dial other than the portion corresponding to the light portion is formed as an opaque portion.

5. The timepiece according to claim 4, wherein an opaque member is laminated to the portion other than the portion corresponding to the light portion of the light means.

6. The timepiece according to claim 1, wherein a transparent portion or a translucent portion is formed at a part or whole of the dial to have the light-transmitting property.

7. The timepiece according to claim 6, wherein the translucent portion is formed by applying surface roughening processing to the transparent portion.

8. The timepiece according to claim 1, wherein the first portion is constructed from a convex portion formed at the dial and the second portion is constructed from a concave portion formed at the outer member.

9. The timepiece according to claim 2, wherein the laminating means is constructed from an electrically insulating member.

10. The timepiece according to claim 1, wherein the outer member is constructed from a timepiece case.

11. The timepiece according to claim 1, wherein the outer member has a case for housing the timepiece movement and an inner frame member provided between an inner periphery of the case and the timepiece movement.

12. The timepiece according to claim 11, wherein the inner frame member is formed according to a shape of the inner periphery of the case.

13. The timepiece according to claim 11, wherein the inner frame member is formed with the second portion to be engaged with the first portion of the dial.

14. The timepiece according to claim 11, wherein a surface of the timepiece movement exposed through a gap between the light means and the inner frame member is colored with a same color as a color of a surface of the light means.

15. The timepiece according to claim 11, wherein the inner frame member has a first member for retaining the timepiece movement and a second member for retaining the timepiece movement which are disposed between the inner periphery of the case and the timepiece movement, the first member and the second member support the timepiece movement between them from opposite sides to position and fix the timepiece movement in the case.

16. The timepiece according to claim 11, wherein an overhanging portion which is a portion overhanging from the light means is formed at the timepiece movement and the inner frame member is provided to the overhanging portion.

17. The timepiece according to claim 15, wherein a surface of the timepiece movement exposed through a gap between the light means and the first member for retaining the timepiece movement is colored with a same color as a color of a surface of the light means.

18. The timepiece according to claim 1, wherein the light means is a solar cell for generating power by receiving the outside light.

19. The timepiece according to claim 11, wherein the light means is a solar cell for generating power by receiving the outside light.

20. The timepiece according to claim 1, wherein the light means is an illuminating unit for illuminating the dial.

21. The timepiece according to claim 11, wherein the light means is an illuminating unit for illuminating the dial.

* * * * *